US006852683B1

(12) United States Patent
Mukogawa et al.

(10) Patent No.: US 6,852,683 B1
(45) Date of Patent: Feb. 8, 2005

(54) DETERGENT COMPOSITION FOR PETROLEUM REFINING APPARATUS

(75) Inventors: Youichi Mukogawa, Fukui (JP); Yutaka Sano, Fukui (JP)

(73) Assignee: Nicca Chemical Co., Ltd., Fukui (JP)

( * ) Notice: Subject to any disclaimer, the term of this patent is extended or adjusted under 35 U.S.C. 154(b) by 176 days.

(21) Appl. No.: 09/980,079

(22) PCT Filed: Jun. 2, 2000

(86) PCT No.: PCT/JP00/03604

§ 371 (c)(1),
(2), (4) Date: Nov. 30, 2001

(87) PCT Pub. No.: WO00/75400

PCT Pub. Date: Dec. 14, 2000

(30) Foreign Application Priority Data

Jun. 3, 1999 (JP) ..... 11-156546

(51) Int. Cl.[7] ..... C11D 7/50
(52) U.S. Cl. ..... 510/407; 510/365
(58) Field of Search ..... 510/407, 365, 510/417

(56) References Cited

U.S. PATENT DOCUMENTS 3,962,151 A * 6/1976 Dekker et al. ..... 510/240
4,031,031 A 6/1977 Yamaguchi et al.
5,723,423 A * 3/1998 Van Slyke ..... 510/188
5,741,502 A * 4/1998 Roberts ..... 424/405
6,534,449 B1 * 3/2003 Gilmour et al. ..... 507/203

FOREIGN PATENT DOCUMENTS

JP 11-166195 6/1999
JP 2000-1680 1/2000

* cited by examiner

*Primary Examiner*—Gregory Webb
(74) *Attorney, Agent, or Firm*—Leydig, Voit & Mayer, Ltd.

(57) ABSTRACT

The detergent composition for petroleum refining apparatus in accordance with the present invention is one used as being mixed with a petroleum solvent when the inside of a petroleum refining apparatus is washed with the petroleum solvent in a nonaqueous system, wherein the detergent composition contains a surfactant having a solubility of at least 10 with respect to a diesel fuel at a temperature of 25° C. When this detergent composition for petroleum refining apparatus is used together with the petroleum solvent, soil components are rapidly impregnated with the petroleum solvent. Consequently, sufficient washing effects can be exhibited. As a result, the washing efficiency can be improved remarkably, whereby the washing time within the petroleum refining apparatus can be shortened greatly.

1 Claim, No Drawings

DETERGENT COMPOSITION FOR PETROLEUM REFINING APPARATUS

TECHNICAL FIELD

The present invention relates to a detergent composition for petroleum refining apparatus.

BACKGROUND ART

As a petroleum refining apparatus is operated, heavy oil contents, which are generated when petroleum is partly polymerized upon heating, and soil components, such as the sludge produced upon deterioration (or degradation) of metals in the inner wall of the apparatus (hereinafter collectively referred to as "soil components"), adhere to the inside of heat exchangers, pipes, heating furnaces, desalters, and the like (hereinafter collectively referred to as "petroleum refining apparatus") constituting the apparatus.

When such soil components accumulate within the petroleum refining apparatus, the petroleum refining efficiency may be reduced. To prevent this from happening, the inside of the petroleum refining apparatus is periodically washed. While water washing with a jet of water has generally been widely used, methods in which an aqueous surfactant solution or a petroleum solvent is circulated within the petroleum refining apparatus for washing have recently been proposed as a method for shortening the washing time.

DISCLOSURE OF THE INVENTION

The above-mentioned method using an aqueous surfactant solution, however, tends to require enormous labor and cost for processing a large amount of waste water. Also, its washing effects have not been proportionally efficient. In the above-mentioned method using a petroleum solvent, the petroleum solvent does not sufficiently infiltrate into soil components which have become bulky as a result of deposition. Therefore, sufficient washing effects have not always been available. Hence, none of these methods has been able to achieve fully satisfactory improvement of washing efficiency and reduction of washing time.

In view of such circumstances, it is an object of the present invention to provide a detergent composition for petroleum refining apparatus, which can exhibit sufficient washing effects when used together with a petroleum solvent and improve the washing efficiency, whereby the washing time within the petroleum refining apparatus can be shortened.

The inventors have repeated diligent studies for solving the above-mentioned problem and, as a result, have found that, when a specific surfactant is mixed into a petroleum solvent used for washing, the solubility of the heavy oil contents and sludge into the petroleum solvent is improved, thus achieving the present invention.

Namely, the present invention provides a detergent composition for petroleum refining apparatus, mixed with a petroleum solvent when the inside of a petroleum refining apparatus is washed with the petroleum solvent in a non-aqueous system, the detergent composition containing a surfactant having a solubility of at least 10 with respect to a diesel fuel at a temperature of 25° C.

In such a detergent composition for petroleum refining apparatus (hereinafter referred to as "detergent composition") in accordance with the present invention, the petroleum solvent containing the surfactant rapidly infiltrates into soil components due to the surface activity of the surfactant. This helps the heavy oil contents in soil components to dissolve into the petroleum solvent, and allows the solidified sludge in the soil components to favorably disperse into the petroleum solvent. As a result, the petroleum solvent exhibits sufficient washing effects, whereby the washing efficiency can be improved.

Also, since the surfactant is excellently good in its solubility to the petroleum solvent, it is mixed with the latter very well, whereby favorable surface active effects are exhibited. As a consequence, the washing efficiency can be improved remarkably.

Preferably, the detergent composition of the present invention further contains a terpene compound. The terpene compound is excellent at dissolving the heavy oil contents contained in soil components, and also is excellent in compatibility with the surfactant. As a consequence, the soil components are fully dissolved into the detergent composition itself, and the surface activity of the surfactant is fully exhibited. Therefore, the washing efficiency is further improved.

In addition, since the terpene compound is excellent in compatibility with the surfactant, if the surfactant has a high viscosity, then mixing it with the terpene compound can lower the viscosity of the detergent composition. As a result, it becomes quite easy for the detergent composition to be injected into the petroleum refining apparatus.

More preferably, the content of the surfactant in the detergent composition is 5 to 80% by weight, whereas the content of the terpene compound in the detergent composition is 20 to 95% by weight, i.e., the mixing ratio of the surfactant and the terpene compound is 5:95 to 80:20 in terms of weight ratio.

If the mixing ratio of the surfactant and the terpene compound lies within such a range, then the petroleum solvent can be infiltrated into soil components more rapidly. Also, the solvent activity of the detergent composition itself can be prevented from lowering due to the relative decrease in the content of terpene compound.

More preferably, in the detergent composition in accordance with the present invention, the petroleum solvent is a light oil, and the above-mentioned detergent composition is dissolved into this petroleum solvent (light oil) by 0.5 to 20% by weight. In other words, the detergent composition of the present invention maybe such that the above-mentioned detergent composition is added to a light oil as the petroleum solvent, whereas it is desirable that the ratio of addition be 0.5 to 20% by weight with respect to the light oil.

Maintaining the content (amount of use or amount of addition) of the detergent composition within such a range reliably helps the heavy oil contents in soil components to dissolve into the petroleum solvent. Also, in this case, the dispersion of the sludge contained in the soil components into the petroleum solvent can reliably be accelerated. Further, the washing efficiency can be prevented from being saturated, whereby washing effects matching the cost or higher can be obtained. Namely, it is advantageous in that the cost performance can be improved.

In the present invention, "diesel fuel" as a solvent for defining the solubility of surfactant is "type-I diesel fuel" defined by the Japanese Industrial Standard JIS K 2204 (1997) "Diesel fuel". On the other hand, "solubility" of the surfactant with respect to the diesel fuel in the present invention is a value expressing, in terms of grams, the limit at which the surfactant transparently dissolves in 100 g of the diesel fuel. Further, "light oil" in the present invention refers to, in petroleum distillates, light and medium distillates other than so-called heavy distillates (A to C heavy oils, residual oil), e.g., such as kerosene, gas oil, and LCO (Light Cycle Oil), which are petroleum distillates having a boiling point of 100 to 330° C.

Also, "nonaqueous system" means that water is not intentionally added thereto upon washing, and does not matter whether or not a water content exists in the soil compositions accumulated within the petroleum refining apparatus. Further, a slight water content may be mixed into the petroleum solvent due to a small water content contained in the detergent composition.

Best Modes for Carrying Out the Invention

In the following, preferred embodiments of the present invention will be explained. The detergent composition of the present invention contains a surfactant having a solubility of at least 10 with respect to a diesel fuel at a temperature of 25° C., and is mixed with a petroleum solvent when the inside of a petroleum refining apparatus is washed with the petroleum solvent in a nonaqueous system.

The petroleum solvent may be any petroleum solvent as long as it can dissolve or disperse soil components, and a light oil can preferably be used, for example. If the above-mentioned solubility of the surfactant is less than 10, then it tends to be harder to become fully compatible with the petroleum solvent, such as light oil, in particular. In this case, there is a tendency that the dissolution of soil components into the light oil or the dispersion of the solidified sludge and the like contained in the soil components into the light oil is not effected favorably.

Examples of the above-mentioned surfactant include petroleum sulfonate, lecithin, sorbitan esters, aliphatic acid esters, alkyl ether nonions, alkylaryl ether nonions, and the like, whereas compounds or components belonging to them can be used separately or in a mixture of two or more species.

Among them, petroleum sulfonate is a sulfonic acid mixture of hydrocarbons generated as a by-product when refining petroleum distillates with sulfuric acid, or the like, for which Sulfol 400, 430, 465, and 500 (registered trade marks; manufactured by Matsumura Oil Co., Ltd.), for example, are commercially available.

Examples of lecithin include soybean lecithin, egg lecithin, and the like, in which soybean lecithin is preferable from the viewpoint of stability in supply in the market and cost efficiency. Also, soybean lecithin is particularly advantageous from the viewpoint of improving washing performances since it is excellent in the permeability to firmly attached soil components and the dispersibility of sludge.

Examples of sorbitan esters include sorbitan monolaurate, sorbitan monooleate, sorbitan monostearate, sorbitan trilaurate, sorbitan trioleate, sorbitan tristearate, and the like. Among them, sorbitan monooleate and sorbitan trioleate are preferably used. These are preferable from the viewpoint of improving washing performances, since they are easy to handle and are excellent in the permeability to firmly attached soil components and the dispersibility of sludge.

Also namable as sorbitan esters are compounds in which an alkylene oxide having a carbon number of 2 to 4 is added to the above-mentioned sorbitan esters, whereas the amount of addition of alkylene oxide is preferably 1 to 3 mol. If the amount of addition exceeds 3 mol, then its solubility to the petroleum solvent tends to decrease.

Among these sorbitan esters, a sorbitan ester having 1 to 2 mol of ethylene oxide added thereto is preferably used in particular, since it is quite effective in improving the dispersion of the sludge content generated upon metal deterioration. It is assumed to be because of the fact that, since an appropriate amount of ethylene oxide is added thereto, a slight hydrophilic property of the sorbitan ester is appropriately enhanced to a small extent, whereby the compatibility of the metal ion or metal compound in the sludge with the petroleum solvent is improved. Its effect is not restricted thereto, however.

Examples of aliphatic esters include glycerin monolaurate, glycerin monopalmitate, glycerin monostearate, glycerinmonooleate, glycerindilaurate, glycerin dioleate, glycerin trioleate, and the like; vegetable oils such as castor oil, coconut oil, soybean oil, and rape-seed oil; or the like.

Among them, glycerin monooleate, glycerin dioleate, glycerin trioleate, and castor oil are preferably used. These are preferable from the viewpoint of improving washing performances, since they are easy to handle and are excellent in the permeability to firmly attached soil components and the dispersibility of sludge.

Further, as with sorbitan esters, also namable are compounds in which an alkylene oxide having a carbon number of 2 to 4 is added to the above-mentioned aliphatic acid esters, whereas the amount of addition of alkylene oxide is preferably 1 to 3 mol. If the amount of addition exceeds 3 mol, then its solubility to the petroleum solvent tends to decrease.

Among these aliphatic acid esters, an aliphatic acid ester having 1 to 2 mol of ethylene oxide added thereto is preferably used in particular, since it is quite effective in improving the dispersibility of the sludge content generated upon metal deterioration. As in the case of the above-mentioned sorbitan esters, it is assumed to be because of the fact that a slight hydrophilic property of the aliphatic acid ester is appropriately enhanced to a small extent, whereby the compatibility of the metal ion or metal compound in the sludge with the petroleum solvent is improved. Its effect is not restricted thereto, however.

An example of the above-mentioned alkyl ether nonions is a compound in which 1 to 5 mol of an alkylene oxide having a carbon number of 2 to 4 are added to an alcohol having a carbon number of 10 to 18. Further, an example of alkylaryl ether nonions is a compound in which 1 to 5 mol of an alkylene oxide having a carbon number of 2 to 4 are added to octyl phenol or nonyl phenol.

Among these surfactants, as the sorbitan esters, aliphatic acid esters, alkyl ether nonions, and alkylaryl ether nonions, those preferably having a hydrophilic-lipophilic balance value (hereinafter referred to as "HLB value") of 1 to 10 are suitable.

If the HLB value of the surfactant is less than the lower limit of the above-mentioned range, then its affinity with the hydrophilic ingredients in the soil components (e.g., metals, metal compounds, and the like in the sludge) tends to become insufficient. If the HLB value exceeds the upper limit of the above-mentioned range, then its dissolution into the petroleum solvent and terpene compounds, which will be explained later, tends to become insufficient. The HLB value herein refers to Griffin's HLB value (ditto in the following).

Preferably, the detergent composition of the present invention further contains, in addition to the above-mentioned surfactant, a compound which can dissolve heavy oil contents. As such a compound, terpene compounds are particularly preferable from the viewpoint of its compatibility with the surfactant.

Examples of terpene compounds include monoterpene compounds, sesquiterpene compounds, diterpene compounds, triterpene compounds, and the like, among which monoterpene compounds are preferable.

Examples of monoterpene compounds include terpene hydrocarbons such as d-limonene, hydrogenated limonene, β-pinene, myrcene, camphene, tricyclene, and terpinolene; and terpene alcohols such as linalool, myrcenol, menthol, geraniol, terpineol, borneol, and hydrogenated terpineol. Among these terpene compounds, one species maybe used alone, or two or more species may be used in combination.

Preferable among these terpene compounds is d-limonene, which is excellent in improving the solubility of the petroleum solvent. Further, if high-temperature washing is carried out by using a petroleum solvent having a higher boiling point, then the viscosity of soil components decreases, so that the firmly attached soil components become easier to peel off, and the dissolution and dispersion of soil components into the petroleum solvent are accelerated. It is desirable for the surfactant and terpene compounds employed in this case to have a boiling point of at least 150° C.

More preferably, the content of the above-mentioned surfactant in the detergent composition is 5 to 80% by weight, whereas the content of the terpene compound therein is 20 to 95% by weight. Namely, it is further preferred that the mixing ratio of the surfactant and the terpene compound is 5:95 to 80:20 in terms of weight ratio.

If this mixing ratio is less than 5:95, then there is a tendency that the petroleum solvent is less likely to rapidly infiltrate into the soil components due to the shortage of surfactant. If the mixing ratio exceeds 80:20, on the other hand, then, though the surface activity is enhanced thereby, the amount of terpene compound relatively decreases, so that the solvent effect of the detergent composition itself lowers. As a result, washing effects tend to be saturated.

More preferably, the detergent composition of the present invention is constituted by a light oil and 0.5 to 20% by weight of the above-mentioned detergent composition dissolved therein. Namely, the detergent composition in accordance with the present invention may comprise a light oil having the above-mentioned detergent composition added thereto, whereas the ratio of addition is desirably 0.5 to 20% by weight with respect to the light oil.

If the amount of the detergent composition is less than 0.5% by weight, then it becomes harder for the petroleum solvent to sufficiently infiltrate into soil components, and there is a tendency that the dissolution and dispersion of the petroleum solvent into the soil components are not fully enhanced. If the amount exceeds 20% by weight, on the other hand, then the washing efficiency tends to be substantially saturated though being somewhat enhanced, whereby washing effects matching the cost or higher may not be obtained.

An example of the method (procedure) of washing the petroleum refining apparatus in accordance with the present invention is as follows. First, a petroleum solvent is put into a mixing bath, and the detergent composition of the present invention is added to the mixing bath so as to attain a predetermined concentration range. Subsequently, these are mixed well, so that the detergent composition is dissolved in the petroleum solvent (the resulting mixed liquid also becoming the detergent composition of the present invention if the amount of addition of the detergent composition is within the preferable range mentioned above). The petroleum solvent containing the detergent composition is further heated, and then is injected into the petroleum refining apparatus to be washed. Thereafter, the petroleum solvent is circulated within the petroleum refining apparatus with a pump or the like.

As another procedure, in a state where a predetermined amount of a heated petroleum solvent is injected into and circulated within the petroleum refining apparatus beforehand, the detergent composition of the present invention may additionally be injected into the petroleum refining apparatus by an amount residing within a predetermined concentration range.

According to such a detergent composition of the present invention, the surface activity ofthe surfactant causes the petroleum solvent to rapidly infiltrate into soil components, which helps heavy oil contents in the soil components to dissolve into the petroleum solvent and allows the sludge in the soil components to favorably disperse into the petroleum solvent. Therefore, the petroleum solvent exhibits sufficient washing effects, so that the washing efficiency can be improved. As a result, the washing time can be made shorter than that conventionally attained.

Also, since the surfactant is excellent in its solubility with respect to light oils such as kerosene, it can be mixed with the petroleum solvent very well, whereby the washing efficiency can be enhanced remarkably. As a consequence, the washing time can be greatly reduced.

If the detergent composition further contains a terpene compound, since the terpene compound is excellent at dissolving the heavy oil contents and the like contained in soil components and also is excellent in compatibility with the surfactant, the soil components can be fully dissolved into the detergent composition itself. Then, the surfactant can fully exhibit its surface activity. As a consequence, the washing efficiency can further be improved, whereby the washing time can be drastically shortened.

Also, since the terpene compound is excellent in compatibility with the surfactant, if the surfactant has a high viscosity, then mixing it with the terpene compound can lower the viscosity of the detergent composition. As a result, it becomes quite easy for the detergent composition to be injected into the petroleum refining apparatus, whereby the operability upon washing can be improved.

Further, if the surfactant and terpene compound having a boiling point of 150° C. or higher are used, then high-temperature washing can be effected by use of a petroleum solvent having a high boiling point. As a consequence, the viscosity of soil components can be lowered, whereby the firmly attached soil components become easier to peel off, and the dissolution and dispersion of soil components into the petroleum solvent are accelerated. Therefore, the washing efficiency can further be improved.

In addition, since the mixing ratio of the surfactant and terpene compound in the detergent composition is 5:95 to 80:20 in terms of weight ratio, the petroleum solvent can rapidly infiltrate the soil components. Also, the solvent activity of the detergent composition itself can be prevented from decreasing due to the relative decrease in the amount of terpene compound. As a result, the solubility of the detergent composition with respect to the soil components and the surface activity of the surfactant can fully be exhibited. As a consequence, the washing efficiency can further be improved.

In the case where the detergent composition is dissolved (added) into the petroleum solvent by 0.5 to 20% by weight, it reliably helps heavy oil contents in soil components to dissolve into the petroleum solvent. Also, it can reliably accelerate the dispersion of the sludge contained in the soil components into the petroleum solvent. These can reliably achieve a sufficient washing efficiency. Further, since the washing efficiency can also be prevented from being saturated, washing effects matching the cost or higher are obtained.

EXAMPLES

In the following, the present invention will be explained in further detail with reference to Examples, which do not restrict the present invention.

Making of Test Piece

Assuming that the soil components adhering to the inside of the petroleum refining apparatus subjected to washing in practice were various, test pieces with various amounts of adhesion of asphalt (soil component) were manufactured as follows.

First, a plurality of cold-rolled steel plates (50 mm×25 mm×1.6 mm thickness) coated with 0.1 g of asphalt were prepared. They were placed on a hot plate at 350° C., so as to be subjected to baking for 1 min, 5 min, and 10 min, respectively, whereby three kinds of test pieces were obtained. (Washing seems to become more difficult as the baking time is longer, since the asphalt content is more solidified.) In the following, those with the baking times of 1 min, 5 min, and 10 min will be referred to as test pieces (1), (2), and (3), respectively.

Also, the dry weight of each test piece was measured before being coated with asphalt and after being coated with asphalt and baked, and the difference between thus measured values was taken, whereby the weight W1 of asphalt attached to the test piece was determined.

Washing Test

First, a diesel fuel (gas oil) or kerosene having the detergent composition added thereto or a diesel fuel (gas oil) alone (100 cc each) and one sheet of test piece were put into a metal pot (with a volume of 120 cc). After being closed, the metal pot was put into a thermostat bath at 130° C. Subsequently, the metal pot was held within the thermostat bath for 1 to 3 hr while in a state where the metal pot was horizontally rotated so as to generate a liquid flow within the metal pot. Thereafter, the metal pot was removed from the thermostat bath, and the test piece was taken out therefrom. Further, after the superfluous oil content attached thereto was wiped off, the test piece was dried for 1 hr with a drier at 180° C.

After cooling, the weight of the test piece was measured. From the difference between this weight and the dry weight of the test piece before being coated with asphalt measured in "Making of Test Piece" mentioned above, the weight W2 of asphalt remaining in the test piece after washing was calculated. Then, the washing ratio was calculated by the following relational expression (1):

$$\text{washing ratio}(\%)=100-(W2/W1)\times 100 \quad (1)$$

Examples 1 to 10

The surfactants (whose details are shown in Table 2) and terpene compounds shown in the following Table 1 were mixed at the compounding ratios shown in Table 1, whereby detergent compositions of Examples 1 to 10 were obtained.

TABLE 1

| | Composition and compounding ratio of detergent composition (terpene compound/surfactant = wt %/wt %) |
|---|---|
| Example 1 | d-limonene/petroleum sulfonate = 50/50 |
| Example 2 | d-limonene/soybean lecithin = 50/50 |
| Example 3 | d-limonene/sorbitan trioleate = 50/50 |
| Example 4 | d-limonene/castor oil = 50/50 |
| Example 5 | d-limonene/petroleum sulfonate = 70/30 |
| Example 6 | d-limonene/soybean lecithin = 60/40 |
| Example 7 | β-pinene/soybean lecithin = 50/50 |
| Example 8 | β-pinene/sorbitan trioleate = 30/70 |
| Example 9 | none/soybean lecithin = 0/100 |
| Example 10 | none/sorbitan trioleate = 0/100 |

TABLE 2

| | Product used | Solubility to diesel fuel (25° C.) | HLB value |
|---|---|---|---|
| Petroleum sulfonate | Sulfol 500 (made by Matsumura Oil Co., Ltd.) | 30 or more | — |
| Soybean lecithin | Lecithin DX (made by Nisshin Oil Mills, Ltd.) | 30 or more | — |
| Sorbitan trioleate | — | 30 or more | 1.8 |
| Castor oil | Refined castor oil (made by Itoh Seiyu K.K.) | 30 or more | — |

Results of Washing Test

The detergent compositions obtained by Examples 1 to 10 were added and dissolved into a diesel fuel (gas oil) or kerosene acting as the petroleum solvent, so as to attain concentrations shown in Table 3, and the above-mentioned test pieces were washed with thus obtained detergent composition solutions. Table 3 shows thus obtained results.

TABLE 3

| | Test piece | Petroleum solvent | Detergent composition | Added amount | Washing time | Washing ratio |
|---|---|---|---|---|---|---|
| Washing Example 1 | (2) | diesel fuel | Example 1 | 5% | 1 hr | 70% |
| Washing Example 2 | (2) | diesel fuel | Example 2 | 5% | 1 hr | 72% |
| Washing Example 3 | (2) | diesel fuel | Example 3 | 5% | 1 hr | 69% |
| Washing Example 4 | (2) | diesel fuel | Example 4 | 5% | 1 hr | 64% |
| Washing Example 5 | (2) | diesel fuel | Example 5 | 5% | 1 hr | 71% |
| Washing Example 6 | (2) | diesel fuel | Example 6 | 5% | 1 hr | 73% |
| Washing Example 7 | (2) | diesel fuel | Example 7 | 5% | 1 hr | 66% |
| Washing Example 8 | (2) | diesel fuel | Example 8 | 5% | 1 hr | 65% |
| Washing Example 9 | (2) | diesel fuel | Example 9 | 5% | 1 hr | 62% |
| Washing Example 10 | (2) | diesel fuel | Example 10 | 5% | 1 hr | 60% |
| Comparative Washing Example 1 | (2) | diesel fuel | — | — | 1 hr | 47% |

TABLE 3-continued

| | Test piece | Petroleum solvent | Detergent composition | Added amount | Washing time | Washing ratio |
|---|---|---|---|---|---|---|
| Washing Example 11 | (3) | diesel fuel | Example 2 | 3% | 2 hr | 52% |
| Washing Example 12 | (3) | diesel fuel | Example 3 | 3% | 2 hr | 50% |
| Comparative Washing Example 2 | (3) | diesel fuel | — | — | 2 hr | 34% |
| Washing Example 13 | (1) | kerosene | Example 1 | 10% | 1 hr | 99% |
| Washing Example 14 | (1) | kerosene | Example 1 | 10% | 2 hr | 100% |
| Washing Example 15 | (1) | kerosene | Example 1 | 10% | 3 hr | 100% |

In Table 3, washing Examples 1 to 15 relate to the results of washing test pieces by use of the detergent compositions of Examples 1 to 10, whereas Comparative Washing Examples 1 and 2 relate to results of washing test pieces by use of a petroleum solvent alone.

First, Comparative Washing Example 1 and Washing Examples 9 and 10 each using test piece (2) were compared with each other. As a result, while the washing ratio of Comparative Washing Example 1 was 47%, the respective washing ratios in Washing Examples 9 and 10 were 60% and 62%, whereby a significant improvement in washing ratio due to Examples was seen. From this result, it has been verified that washing performances are clearly improved when a diesel fuel (gas oil; petroleum solvent) mixed with a detergent composition containing soybean lecithin (surfactant) is used, as compared with the conventional case of washing with the diesel fuel (gas oil) alone.

Also, Washing Examples 1 to 8 including terpene compounds exhibited washing ratios with further higher values of 64% to 73%. From this result, it has been verified that washing effects are remarkably improved when a diesel fuel (gas oil; petroleum solvent) mixed with a detergent composition containing a surfactant and a terpene compound is used, as compared with the conventional case using the diesel fuel (gas oil) alone.

Next, Comparative Washing Example 2 and Washing Examples 11 and 12 each using test piece (3) were compared with each other. As a result, while the washing ratio of Comparative Washing Example 2 was 34%, the respective washing ratios in Washing Examples 11 and 12 were 52% and 50%. From this result, it has been verified that the diesel fuel (gas oil; petroleum solvent) mixed with the detergent composition of the present invention also exhibits favorable washing effects with respect to asphalt (soil component) having a very high degree of adherence.

Also, the washing ratio in Washing Examples 13 to 15 using test piece (1) was 99% to 100%. From this result, it has been verified that the kerosene (petroleum solvent) mixed with the detergent composition of the present invention can substantially completely eliminate asphalt (soil component) having a low degree of adherence.

From these test results, it is understood that, when the detergent composition in accordance with the present invention is used together with the petroleum solvent, sufficient washing effects can be obtained independently of the degree of adherence of soil components, i.e., with respect to various modes of attachment of soil components.

INDUSTRIAL APPLICABILITY

As explained in the foregoing, the detergent composition for petroleum refining apparatus of the present invention can exhibit sufficient washing effects when used together with a petroleum solvent, so as to remarkably improve the washing efficiency, thereby making it possible to greatly shorten the washing time within the petroleum refining apparatus.

What is claimed is:

1. A detergent composition for non-aqueous washing of the inside of a petroleum refining apparatus, the composition comprising:

a petroleum solvent comprising a light oil, a surfactant having a solubility of at least 10 with respect to a diesel fuel at a temperature of 25° C. and comprising at least one of petroleum sulfonate, lecithin, sorbitan esters having an HLB value of 1 to 10, aliphatic esters having an HLB value of 1 to 10, alkyl ether nonions having an HLB value of 1 to 10, and alkylaryl ether nonions, and a terpene compound, wherein the surfactant comprises 5 to 80% by weight of the mixture of the surfactant and the terpene compound, and 0.5 to 20% by weight of the mixture of the surfactant and the terpene compound is dissolved in the light oil.

* * * * *